US007417204B2

(12) United States Patent
Nam et al.

(10) Patent No.: US 7,417,204 B2
(45) Date of Patent: Aug. 26, 2008

(54) COOKING APPARATUS AND METHOD FOR CONTROLLING THE SAME

(75) Inventors: Hyeun Sik Nam, Seoul (KR); Young Sok Nam, Seoul (KR); Yong Soo Lee, Gyeonggi-do (KR); Seong Ho Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/686,465

(22) Filed: Mar. 15, 2007

(65) Prior Publication Data

US 2007/0251936 A1 Nov. 1, 2007

(30) Foreign Application Priority Data

Mar. 15, 2006 (KR) ..... 10-2006-0024069
Mar. 15, 2006 (KR) ..... 10-2006-0024070
Mar. 23, 2006 (KR) ..... 10-2006-0026631
May 4, 2006 (KR) ..... 10-2006-0040738

(51) Int. Cl.
*H05B 6/62* (2006.01)
*A21B 1/02* (2006.01)
*A47J 37/06* (2006.01)

(52) U.S. Cl. ..... 219/413; 219/403; 219/771; 426/244; 399/358

(58) Field of Classification Search ..... None
See application file for complete search history.

(56) References Cited

U.S. PATENT DOCUMENTS 1,380,656 A * 6/1921 Lauth ..... 99/358
2,226,036 A * 12/1940 Watson ..... 99/358
2,621,587 A * 12/1952 Savio ..... 99/358
6,891,133 B2 * 5/2005 Shozo et al. ..... 219/403

FOREIGN PATENT DOCUMENTS

KR 10-1990 005926 5/1990
KR 20 0253789 10/2001
KR 20 0358280 7/2004
KR 20 0387337 6/2005

OTHER PUBLICATIONS

English language Abstract of KR 0387337.
English language Abstract of KR 10-1990-005926.
U.S. Appl. No. 11/737,342 to Nam et al., which was filed on Apr. 19, 2007.
U.S. Appl. No. 11/743,419 to Nam et al., which was filed on May 2, 2007.
English language Abstract of KR 20-0253789.
English language Abstract of KR 20-0358280.

* cited by examiner

*Primary Examiner*—Joseph M Pelham
(74) *Attorney, Agent, or Firm*—Greenblum & Bernstein, P.L.C.

(57) ABSTRACT

A cooking apparatus includes a housing including a cooking chamber, a heating unit detachably mounted in the housing, and a power connection portion for connecting the heating unit to an external power source. The heating unit can heat food when the heating unit is located in the housing, and the heating unit can independently heat food when the heating unit is removed from the housing.

18 Claims, 16 Drawing Sheets

COOKING APPARATUS AND METHOD FOR CONTROLLING THE SAME

This application claims the benefit of the Patent Korean Application Nos. 10-2006-0024069, filed on Mar. 15, 2006, 10-2006-0024070, filed on Mar. 15, 2006, 10-2006-0026631, filed on Mar. 23, 2006, and 10-2006-0040738, filed on May 4, 2006, which are each incorporated by reference as if fully set forth herein.

BACKGROUND OF THE INVENTION

1. Field of the Invention

The present invention relates to a cooking apparatus, and, more particularly, to a cooking apparatus and a method for controlling the same.

2. Discussion of the Related Art

In general, there are a variety of types of cooking appliances, such as ovens, microwave ovens, and other suitable types of ovens. Microwave ovens are provided with only a magnetron, or both with a magnetron and a heater for cooking food. An oven is a cooking appliance designed for cooking food enclosed therein with dry heat. A heat source for supplying the heat to the food may be an electric heater or a gas heater.

In general, ovens are provided with a cavity, a space for holding the food, a door for opening/closing the cavity, and a heater for cooking the food.

The cavity is a cooking space in a body of the oven, and the door is hinged on a front of the oven which forms the cavity, and may be opened/closed in left/right or up/down directions.

The heater is on one side of an inside the cavity for supplying thermal energy for cooking the food. The thermal energy from the heater is transmitted to the food by convection or radiation.

However, conventional cooking appliances have the following problems.

First, because the related art cooking appliances transmit thermal energy from the heater to a surface of the food by convection or radiation, heating of the food to an inside thereof takes a long time period.

Second, because the heat from the heater of the cooking appliance heats the entire inside of the cavity, the thermal energy that cooks the food is only a portion of the thermal energy that the heater generates.

Moreover, the thermal energy leaks to an outside of the cooking appliance through gaps between the body of the cooking appliance and the door, which reduces energy efficiency of the related art cooking appliances.

Third, the transmission of thermal energy from the heater of the related art cooking appliances to the surface of the food causes a problem of non-uniform heating of the food, which forms portions of the food that are partially burnt or undercooked.

Fourth, the heater of the related art cooking appliances fixedly secured to the inside thereof causes a problem of one-sided transmission of thermal energy from the heater to the inside of the cavity. Because the heater is fixedly secured to the inside of the cooking appliance, the user can not vary a position of the heater. Moreover, a mounting structure of the heater is complicated, and use of the heater is not convenient.

Fifth, even though cooking methods vary with food conditions (for example, moisture contents) even in the same type of food, and cooking levels the users desire vary with tastes of the users, the related art cooking appliances fail to provide food cooked as a user desires, since as the related art cooking appliances supply the thermal energy to the food from the heater without variation.

These problems cause customer complaints and deteriorate product reliability.

SUMMARY OF THE INVENTION

Accordingly, the present invention is directed to a cooking apparatus and a method for controlling the same.

An object of the present invention is to provide a cooking apparatus and a method for controlling the same, which can shorten a cooking time period of food.

Another object of the present invention is to provide a cooking apparatus and a method for controlling the same, which can make energy efficiency of cooking greater.

Another object of the present invention is to provide a cooking apparatus and a method for controlling the same, which can supply thermal energy to an inside of food directly to enable uniform cooking of the food.

Further object of the present invention is to provide a cooking apparatus and a method for controlling the same, which is movable and has a simple cooking method for convenience of the user.

Still further object of the present invention is to provide a cooking apparatus and a method for controlling the same, which can cook food to the taste of the user.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a cooking apparatus includes a housing having a cooking chamber, a heating unit detachably mounted to the housing, and a power connection portion for connecting the heating unit to an external power source, wherein the heating unit can heat food when the heating unit is located in the housing, and the heating unit can independently heat food when the heating unit is removed from the housing.

The heating unit may include a plurality of electrodes which are not in contact with one another and are configured to be brought into contact with the food.

The heating unit may further include electrode supporting members that support the plurality of electrodes.

The heating unit may further include a container configured to hold foreign matter formed during cooking of food.

Each electrode may include electrode pins arranged at predetermined intervals and an electrode body connecting the electrode pins.

The heating unit may further include a guide that guides foreign matter from the food to the container.

The heating unit may further include fastening projections provided on the electrodes or the electrode supporting members, and fastening holes provided in the other of the electrodes or the electrode supporting members, and corresponding to the fastening projections.

The cooking apparatus may further include a transformer for varying power to the electrodes according to the type of food to be heated.

The power connection portion may include a socket connected to the plurality of electrodes, and a socket cover for preventing foreign matter from accumulating on the socket.

The power connection portion may include an electrode terminal extended from each of the electrodes, and an intermediate connection member for connecting the electrode terminal to the external power source.

The heating unit may include a heater configured to heat the food, and a heater support that supports the heater.

The heating unit may further include a grill provided on the heater support for supporting the food thereon.

The heating unit may further include a container located under the heater support for holding foreign matter formed during cooking of the food.

The heating unit may further include a rack for supporting the heating unit in the cooking chamber, and a rack supporting member that supports the rack.

At least some of the plurality of electrodes may form an exterior of a cooking container in which the food is placed.

The electrodes may have one side forming a portion of an inside of the cooking container, and another side forming a portion of an outside of the cooking container.

The electrodes may be passed through a container wall from the inside to the outside of the container.

The cooking apparatus may further include a controller that controls a direction of current flow through the food in the cooking container.

In another aspect of the present invention, a cooking apparatus includes a movable heating unit having a plurality of electrodes configured to heat an object to be cooked using the resistance of the object, and a power connection portion for supplying power from an external power source to the electrodes.

In further aspect of the present invention, a method for controlling a cooking apparatus includes detachably mounting a heating unit in a housing of the cooking apparatus, the heating unit having a plurality of electrodes which are not in contact with one another, and controlling a direction of current flow through food placed between the electrodes.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

A cooking appliance of the present invention will be described in detail with reference to FIG. 1.

Figure 1:
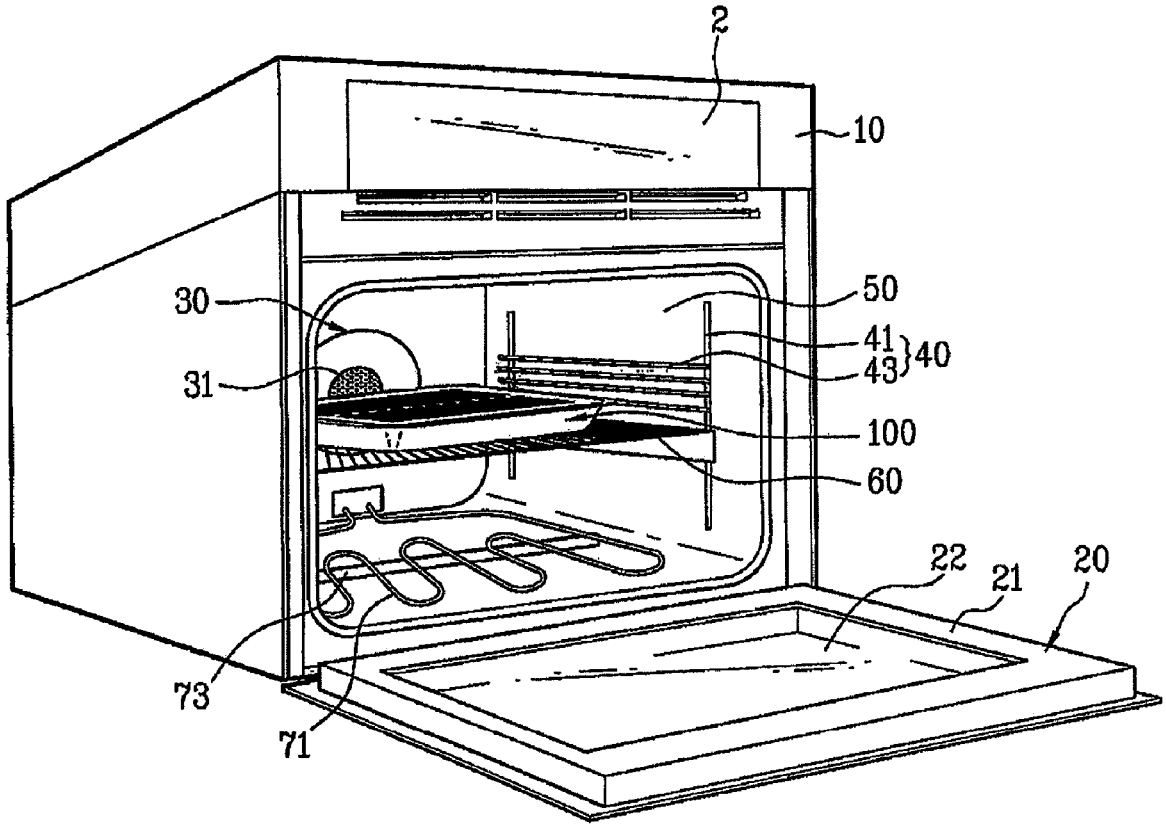
FIG. 1 is a perspective view illustrating a cooking appliance in accordance with an embodiment of the present invention.

Referring to FIG. 1, the cooking appliance includes a cabinet or housing 10 for providing a space for cooking food, a heating unit 100 for supplying heat to the food, and a door 20 for opening/closing the cabinet.

The cabinet has a cavity 50 therein, which is a space for cooking the food, and a control panel 2 at an upper portion of a front thereof for controlling the cooking appliance.

The cabinet has the door 20 hinged on the front thereof. The control panel 2 may be remotely controlled, or located in a different position on the cabinet, and the door 20 may be slidably mounted to the front of the cabinet. The door may also be hinged so as to tilt sideways around a vertical hinge, instead of upwards and downwards.

There is a rack 60 in the cabinet for placing a heating unit 100. Of course, food may be placed on the rack 60 directly. The rack 60 can be mounted at different levels according to the intention of a user. The rack 60 has rack supporters 40 at opposite edges for supporting the rack 60.

The rack supporter 40 includes a plurality of rack guides 43 for supporting the rack 60, and guide supporting members 41 for supporting the rack guides 43. The guide supporting members 41 are fixedly secured to an inside surface of the cabinet, and the rack guides 43 are mounted to the guide supporting members 41 at different levels.

The present invention is not limited to above embodiment, but a tray may be provided in the cavity for placing the food therein. The tray may be fixedly secured to the inside of the cavity, or the tray may be rotatably mounted.

By rotating the tray during cooking of food, the food can be cooked uniformly. For rotating the tray, there may be a driving motor (not shown) under the tray, and a power transmission (not shown) may be provided for transmission of rotating force to the tray from the driving motor.

Mounted on an inside surface of the cabinet, there are immovable heaters for supplying thermal energy for cooking the food. The thermal energy from the immovable heaters is transmitted to the food by convection or radiation.

The immovable heaters include a first heater (not shown) at an upper portion of the inside of the cabinet, a second heater (not shown) at a rear of the inside of the cabinet, and a third heater 71 on a bottom of the inside of the cabinet.

The first heater, provided for emitting an infrared ray for heating the food, is used for roasting food. It is preferable that the first heater is fixedly secured to the upper portion of the inside of the cabinet. Of course, the first heater may be movably mounted to the upper portion of the inside of the cabinet.

The second heater is positioned on an inside of the cabinet opposite to the door 20, for supplementary supply of thermal energy to the food placed in the cabinet. The second heater is in a second heater housing 30, and a fan (not shown) is mounted in the vicinity of the second heater for transmission of the heat from the second heater to the inside of the cabinet. The fan serves to distribute air heated by the second heater inside of the cavity, uniformly.

The second heater housing 30 has a suction opening 31 in a front for drawing air from the inside of the cavity, and a discharge opening (not shown) in a side for discharging air heated by the heater.

The third heater 71 is positioned under the rack 60 on a heater supporting member 73. The third heater 71 may be provided for baking of foods such as bread or cake, and may have a baking container (not shown) placed thereon.

In the meantime, it is preferable that a space to be heated with the third heater is limited, not to the entire space of the inside of the cabinet, but to a space for baking the bread or the like. In detail, it is preferable that the space for baking the bread or the like is isolated with a screen (not shown) provided in the cabinet.

The immovable heaters can transmit thermal energy to the food as the immovable heaters are turned on/off selectively according to cooking methods of the food.

The door 20 on the front of the cabinet includes a door frame 21 which forms a periphery of the door, and a door glass 22 on an inner side of the door frame. The door frame 21 at a bottom thereof is hinged on the cabinet, and may have a sealing member (not shown) on an inner circumference for sealing the inside and an outside of the cabinet.

It is preferable that the door glass 22 is formed of a transparent and heat resistant material for viewing the inside of the cabinet, and resistance to heat.

Mounted in the cabinet, there is a transformer for supplying power according to types of food to be cooked. The transformer is connected to the control panel 2 for user's control.

For example, if the user selects a type of cooking intended to cook the food with the control panel 2, a control unit connected to the control panel controls the transformer to control power to be supplied to the immovable heaters and the heating unit 100.

Figure 2:
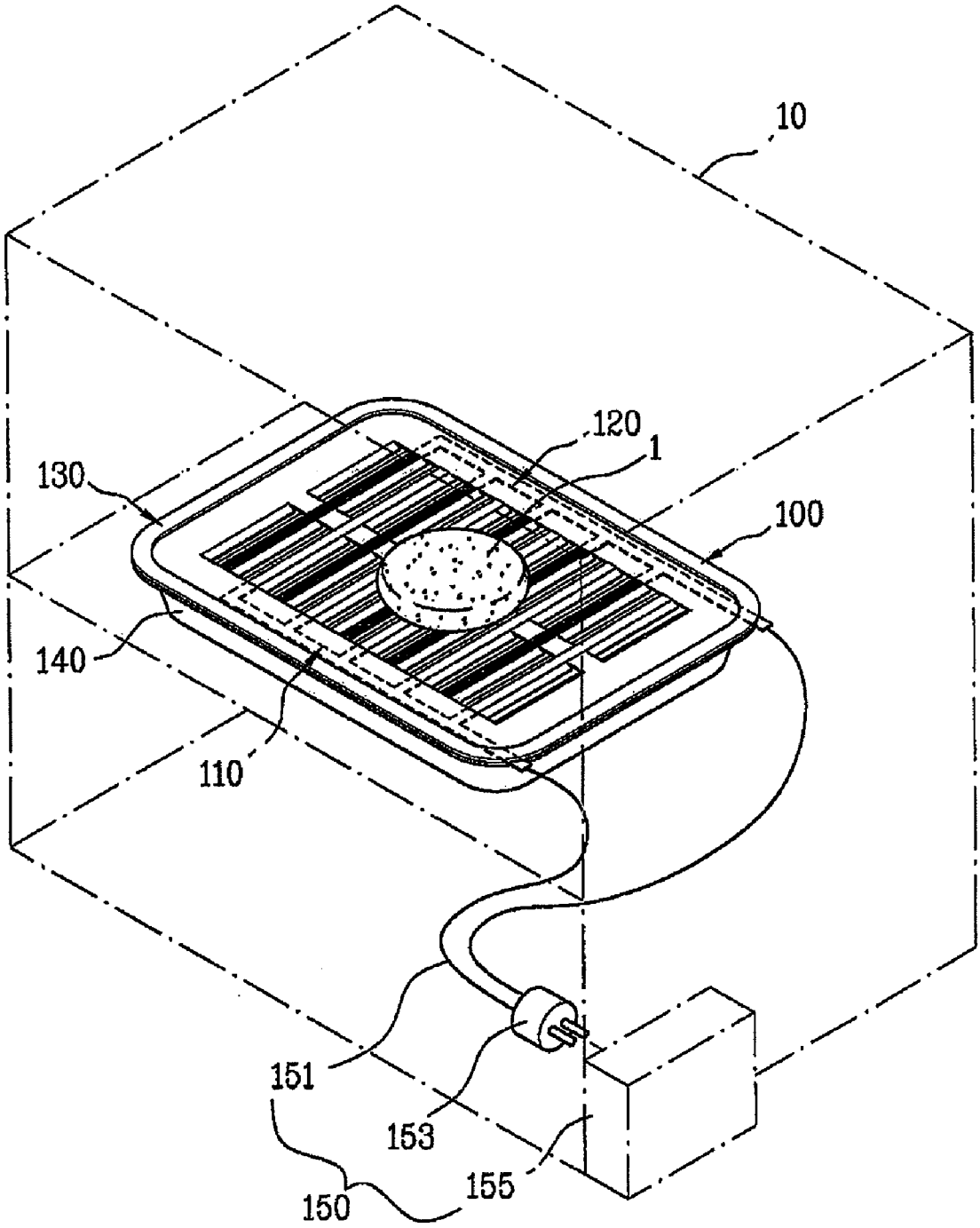
FIG. 2 is a perspective view illustrating a heating unit in the cooking appliance in FIG. 1 in accordance with a first embodiment.
Figure 3:
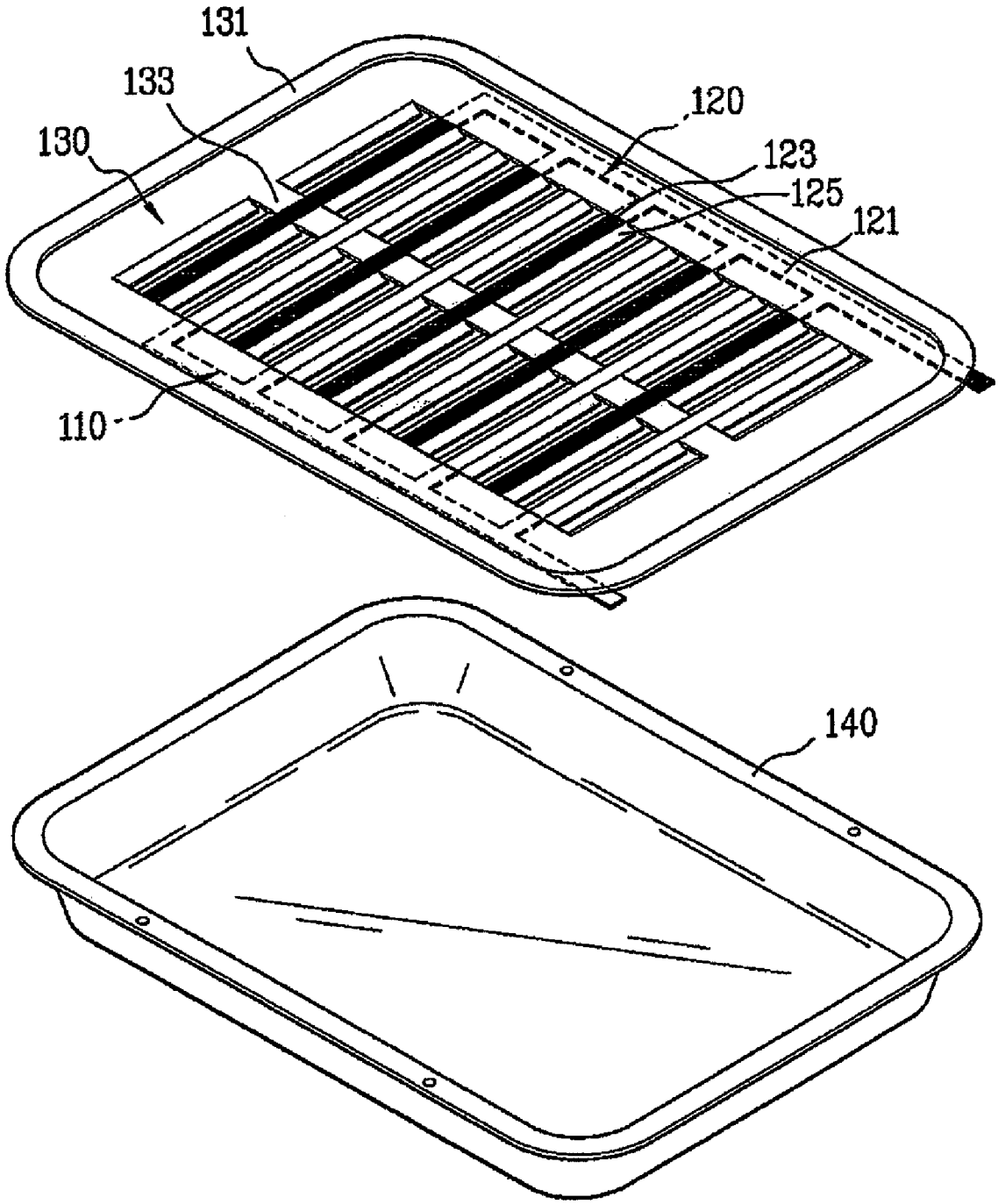
FIG. 3 is an exploded perspective view illustrating key parts of the heating unit in FIG. 2.

A heating unit in accordance with a first embodiment of the present invention will be described with reference to FIGS. 2 and 3.

The heating unit 100 includes a plurality of electrodes 110, and 120 for applying a current to the food 1 to cook the food, and an electrode supporting member 130 for supporting the plurality of electrodes such that the plurality of electrodes 110, and 120 are not brought into contact with one another.

Secured to an underside of the electrode supporting member 130, there is a container 140 for holding foreign matters including oil produced when the food is cooked.

A case when two electrodes, i.e., a first electrode 110 and a second electrode 120, are provided will be described hereafter.

The second electrode 120 includes a plurality of electrode pins 123 arranged at predetermined intervals, and an electrode body 121 connected to the electrode pins 123. Of course, the first electrode 110 has the same system. The first electrode 110 and the second electrode 120 are mounted on the electrode supporting member 130 in a state the first electrode 110 and the second electrode 120 are not in contact with the other.

An external power supply source for supplying power to the first electrode 110 and the second electrode 120 may be either an AC, or a DC power source as what is required is just a flow of a current through the electrodes.

The first electrode 110 and the second electrode 120 are arranged alternately, such that the food 1 to be cook is required to be in contact both with the first electrode 110 and the second electrode 120.

In order to make the current to flow through the food 1, the food is required to be in contact both with first electrode 110 and the second electrode 120 which have a potential difference. Once the current flows through the food, heat is generated in the food owing to an electric resistance of the food itself. Of course, the food 1 is required to have a predetermined moisture content for flow of the current.

Since the heat generated in the food spreads throughout the food uniformly, the food can be cooked uniformly. Moreover, an electric energy from the power source is converted into a thermal energy by the resistance of the food, entirely. Eventually, the embodiment has advantages in that energy efficiency is improved, and a cooking time period is shortened.

The electrode pin 123 has a guide 125 mounted thereto for guiding foreign matters, such as oil, from the food 1 to the holding container. The guide 125 is sloped downward from an edge of the electrode pin 123 at a predetermined angle. Therefore, the oil from the food in contact with the electrode pin 123 flows following the guide 125 naturally until the oil drops into the holding container.

The electrode supporting member 130 forms a grill for placing the food thereon, together with the first electrode 110 and the second electrode 120. The electrode supporting member 130 includes an outer frame 131 which forms an outer periphery thereof, and an intermediate frame 133 extended inwardly from the outer frame. The outer frame 131 has the electrode body 121 mounted thereon, and the intermediate frame 133 supports an underside of the electrode pin 123.

It is preferable that the electrode supporting member 130 is a nonconductor of electricity through which no electricity can flow. Because, if the electrode supporting member 130 is a conductor, the first electrode and the second electrode can be connected through the supporting member electrically, resulting in possible failure of current flow through the food which has an electric resistance higher than the supporting member.

Under the electrodes and the electrode supporting member 130, there is the holding container 140 for holding foreign matters, such as oil, from the food when the food is cooked. The holding container 140 has a shape in conformity with the electrode supporting member, and fastened to the grill with a fastening member (not shown).

Of course, the holding container 140 can be formed of a transparent material for viewing an inside of the holding container from an outside of the holding container 140. If the holding container is a conductor, it is required that the holding container is not in contact with the first, and second electrodes, and if the holding container is a nonconductor, it does not matters even if the holding container is in contact with the first, and second electrodes.

In the meantime, the heating unit has a power connector 150 mounted thereto for connecting the first electrode 110 and the second electrode 120 to an external power source. The power connector 150 includes cables 151 connected to the first electrode 110 and the second electrode 120 respectively, a plug 153 provided at an end of the cables 151, and a socket 155 into which the plug 153 is inserted.

Of course, the power connector 150 may be formed of any suitable material as far as a current can flow therethrough when the power connector 150 is connected to the external power source. Moreover, a socket cover (not shown) is provided to a front of the socket for preventing foreign matters from accumulating on the socket 155.

The socket 155 is a direct connection passage between the heating unit 100 and the external power source. The socket cover 100 serves to make power supply smooth by preventing contamination of the socket 155 when the heating unit 100 is not in use.

The heating unit 100 is mounted on the rack in the cavity, and the food with a predetermined moisture content is placed on the heating unit. However, the heating unit is not limited to the above embodiment, but can cook food separate from the cooking appliance, such as the oven, or microwave oven, or the like, independently.

In detail, as far as the heating unit is connected to the external power source, the heating unit can be used anywhere. Even if the heating unit is used, not in an enclosed space, but in an open space, no thermal loss can take place easily. Because the heating unit generates a thermal energy owing to resistance of the food itself when a current is let flow through the food, the food is cooked by the thermal energy.

The steps of a process for cooking food with a cooking appliance of the present invention will be described with reference to FIGS. 1 to 3.

At first, the user mounts the heating unit 100 on the rack 60 in the cabinet. Then, after placing food intended to be cooked on the heating unit 60, the user closes the door 20. After selecting a cooking method by using the control panel 2, a cooking start button is pressed.

Then, power is supplied from the external power source to immovable heaters or the heating unit 100. For an example, more than one of the immovable heaters and the heating unit can be put into operation, or the heating unit 100 and the immovable heaters may be put into operation independently.

The steps of a process for cooking the food with the heating unit 100 will be described. Upon putting the heating unit into operation, a voltage is applied to the first electrode 110 and the second electrode 120 from the external power source, a voltage gap of the voltages respectively applied to the first electrode and the second electrode causes a current to flow through the food.

The current flows through the socket 155, the plug 153, and the cables 151 from the external power source, toward an electrode which has a relatively higher voltage.

A current flow will be described assuming that a voltage on the first electrode 110 is higher than a voltage on the second electrode 120. Accordingly, the current flows from the first electrode 110 to the second electrode 120 through the food. The current passed through the second electrode 120 flows to the external power source through the cable 151, the plug 153, and the socket 155.

In this instance, since the food has electric resistance of its own, an electric energy supplied thereto from an outside of the food is converted into a thermal energy. At the end, the food is cooked by heat generated in the food. Moreover, if a thermal energy is supplied from the immovable heaters while the food is cooked with the heating unit, the food can be cooked within a relatively short time period.

The oil produced during cooking of the food moves following the guide 125, and held in the holding container 140, and other foreign matters produced during cooking of the food is also held in the holding container.

Figure 4:
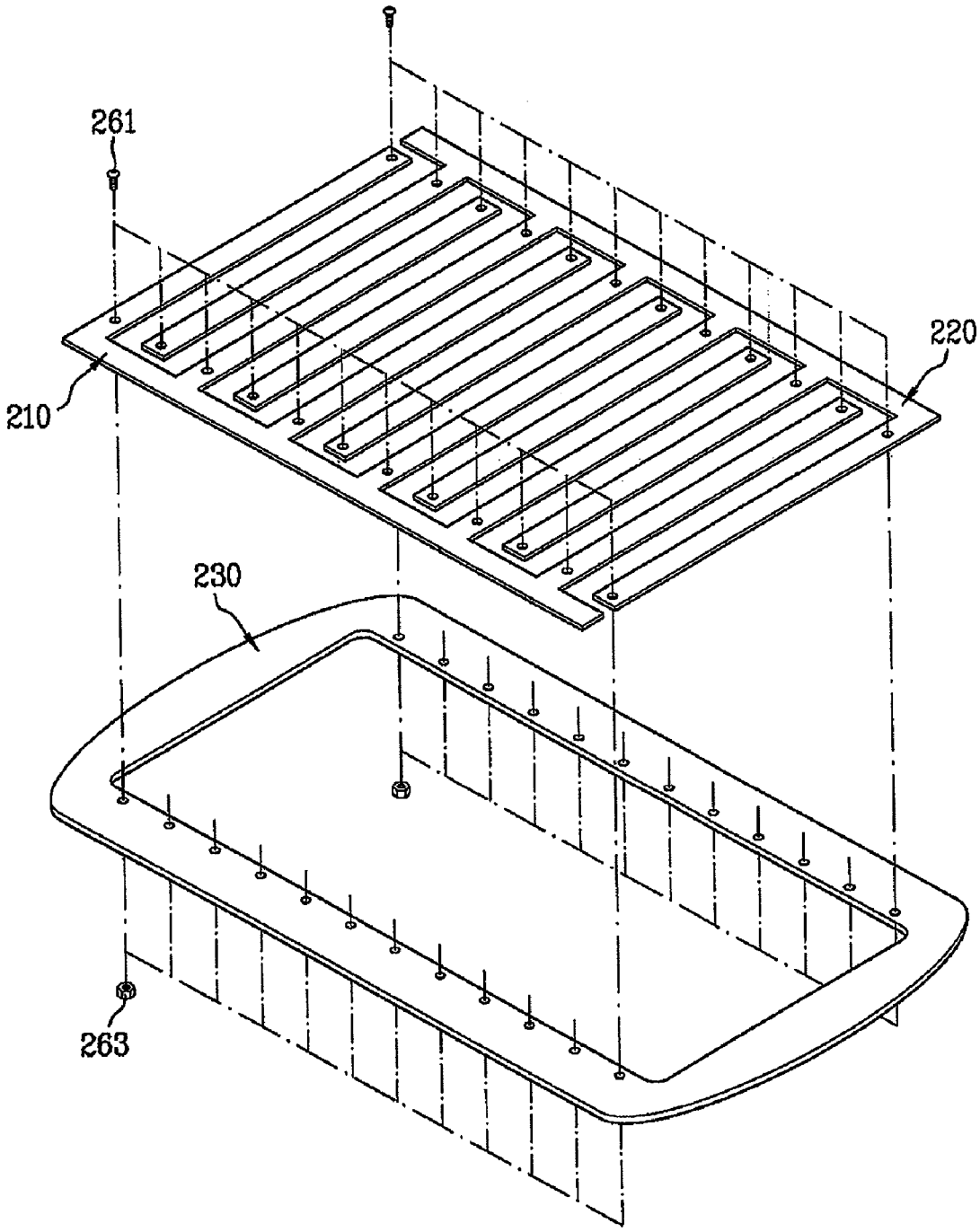
FIG. 4 is a perspective view illustrating a heating unit in the cooking appliance in FIG. 1 in accordance with a second embodiment.

A heating unit in accordance with a second preferred embodiment of the present invention will be described with reference to FIG. 4.

Similar to the foregoing embodiment, the heating unit of the second embodiment includes a plurality of electrodes 210, and 220 for making a current to flow through food to cook the food, and an electrode supporting member 230 for supporting the plurality of electrodes such that the plurality of electrodes 210 and 220 are not in contact with one another.

However, different from the foregoing embodiment, the second embodiment has the electrode supporting member 230 of a nonconductor of electricity. Moreover, the electrode supporting member 230 and the plurality of electrodes 210, 220 are held together with fastening members 261, and 263.

Of course, the heating unit may be used in a condition in which the heating unit is simply put on the supporting member. Moreover, the supporting member may be used in a condition in which the supporting member is not held together with the holding container under the supporting member, but simply put on the holding container.

Figure 5:
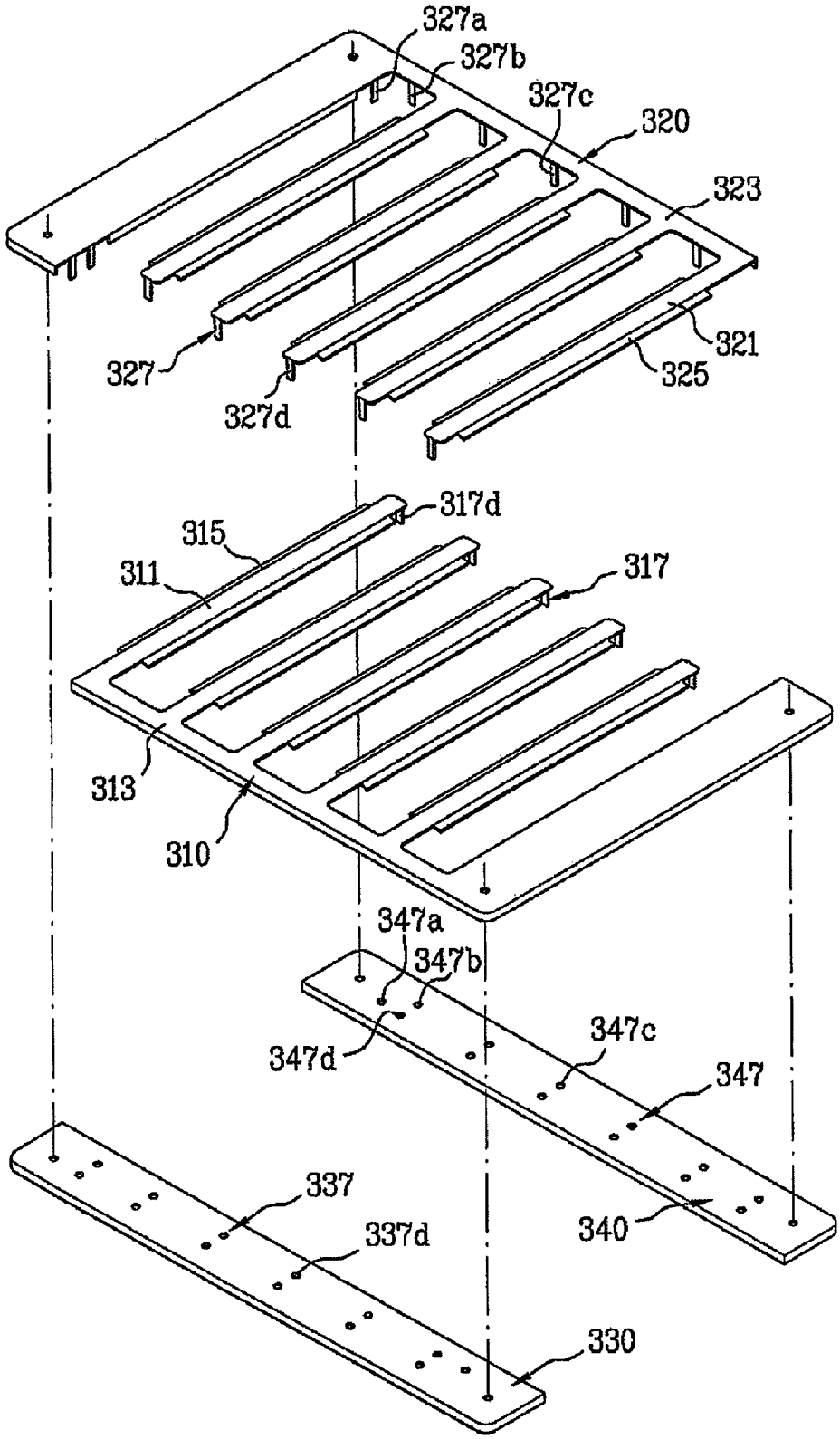
FIG. 5 is a perspective view illustrating a heating unit in the cooking appliance in FIG. 1 in accordance with a third embodiment.
Figure 6A:
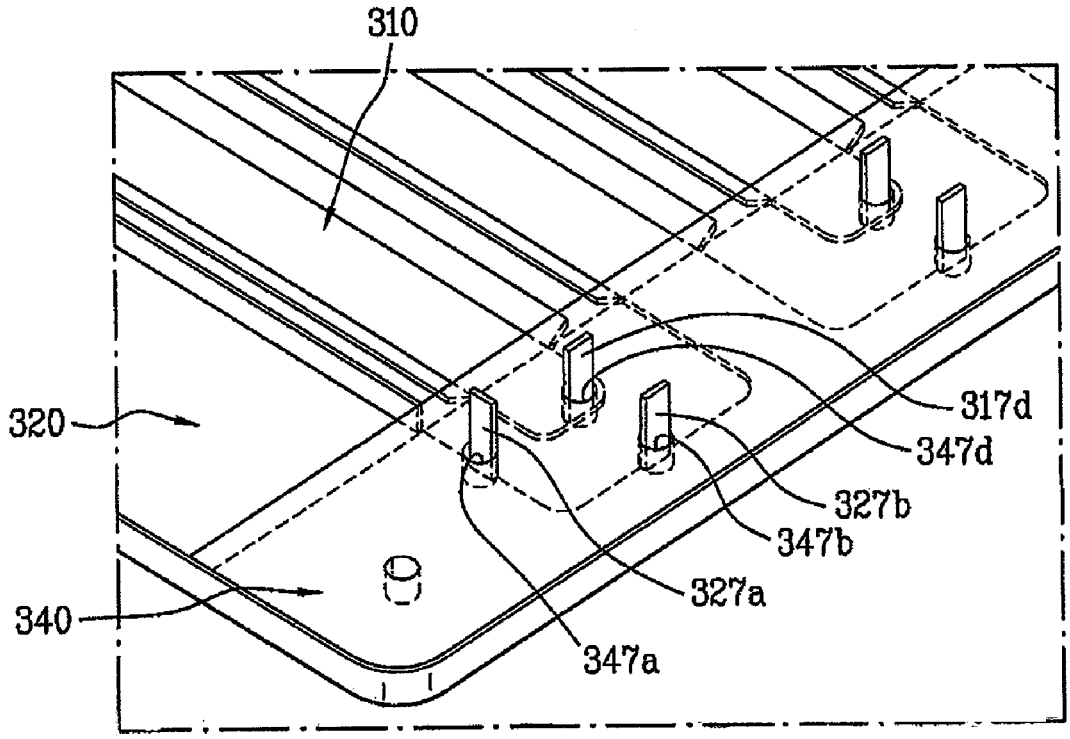
FIG. 6A is a perspective view illustrating a condition before assembly of the heating unit in FIG. 5 is finished.

A heating unit in accordance with a third embodiment of the present invention will be described with reference to FIGS. 5 and 6.

Similar to the foregoing embodiments, the heating unit of the third embodiment of the present invention includes a plurality of electrodes 310 and 320 not in contact with one another, and electrode supporting members 330 and 340 for supporting the electrodes.

However, different from the foregoing embodiments, the heating unit in accordance with the third embodiment of the present invention has electrodes which partially form outer periphery of the heating unit. For this, the supporting member 330, and 340 includes a plurality of plates arranged at fixed intervals, so that opposite edges of each of the electrodes 310 and 320 are placed on the plates, respectively.

In detail, the electrode has fastening projections 317 and 327 extended downward from opposite edges, and the electrode supporting member has fastening holes 337, and 347 in correspondence to the fastening projections. At the end, as the electrodes and the electrode supporting members are fastened together, the electrodes form portions of a rectangular periphery of the heating unit.

The steps of a process for assembling the heating unit will be described. In the following description, it is assumed that the plurality of electrodes are a first electrode 310 and a second electrode 320, and the plurality of plates are a first plate 330 and a second plate 340. The first electrode 310 includes plural electrode pin portions 311, extending from body portion 313, and having guides 315. The second electrode 320 includes plural electrode pin portions 321, extending from body portion 323, and having guides 325.

For cooking the food, at first, the first electrode 310 and the second electrode 320 which make a current to flow to the food are fastened to the first plate 330 and the second plate 340, respectively.

Figure 6B:
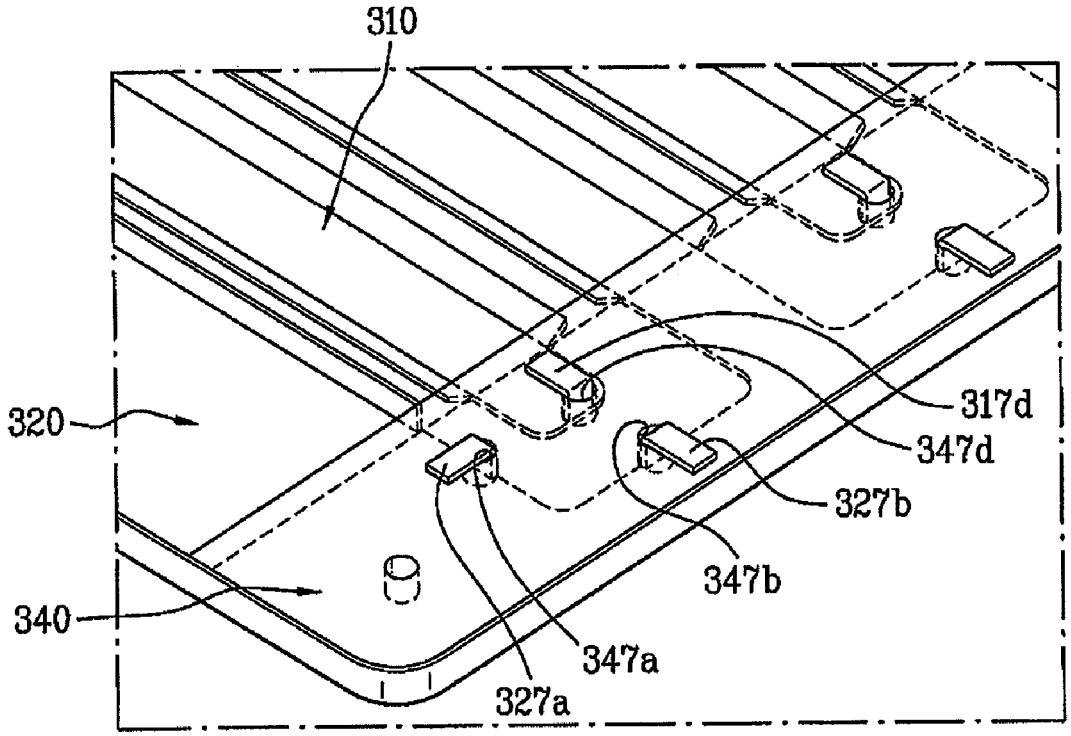
FIG. 6B is a perspective view illustrating a condition after assembly of the heating unit in FIG. 5 is finished.

In this instance, the fastening projections 317 and 327 on the electrodes are placed in the fastening holes 337 and 347 respectively (see FIG. 6A), and a portion of each of the fastening projections respectively passed through the fastening holes is bent, to fasten the electrode to the plate 330 or 340 (see FIG. 6B).

Of course, the first electrode 310 and the second electrode 320 are fastened to the first and second plates respectively such that the first electrode 310 and the second electrode 320 are not in contact with each other. In detail, a first fastening projection 327*a*, and a second fastening projection 327*b* on the second electrode 320, and a third fastening projection 317*d* on the first electrode 310 correspond to a first fastening hole 347*a*, a second fastening hole 347*b*, and a third fastening hole 347*d* in the second plate, respectively.

A fourth fastening projection 327*d* corresponds to a fourth fastening hole 337*d* in the first plate, and a fifth fastening projection 327*c* on the second electrode corresponds to the fifth fastening hole 347*c* in the second plate.

Upon finishing fastening of the electrodes to the electrode supporting members respectively, the holding container which is to hold foreign matters formed during cooking of the food is fastened to the electrode supporting member, thereby finishing assembly of the heating unit.

Figure 7:
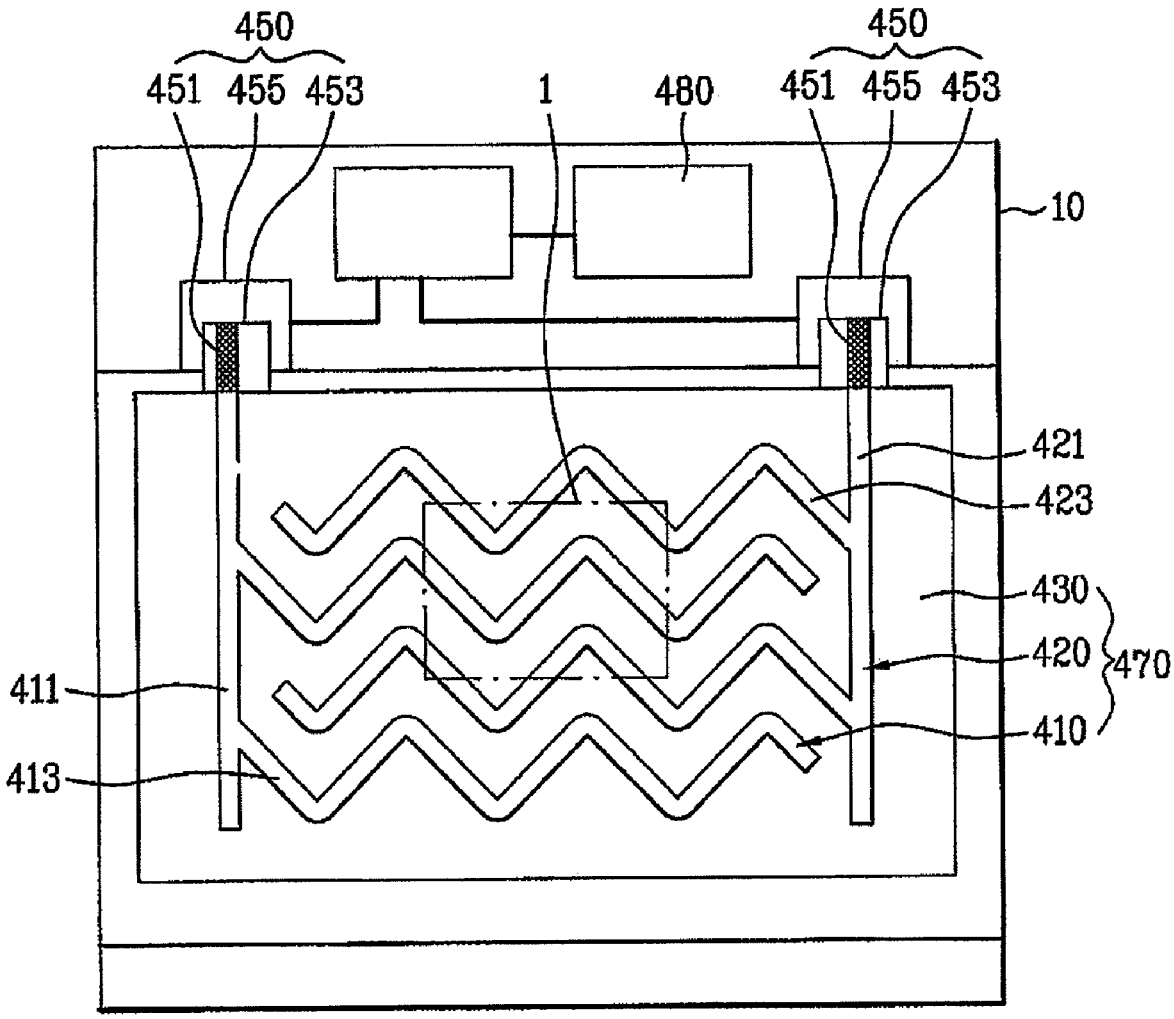
FIG. 7 is a section illustrating key parts of a cooking appliance in accordance with another embodiment of the present invention.
Figure 8:
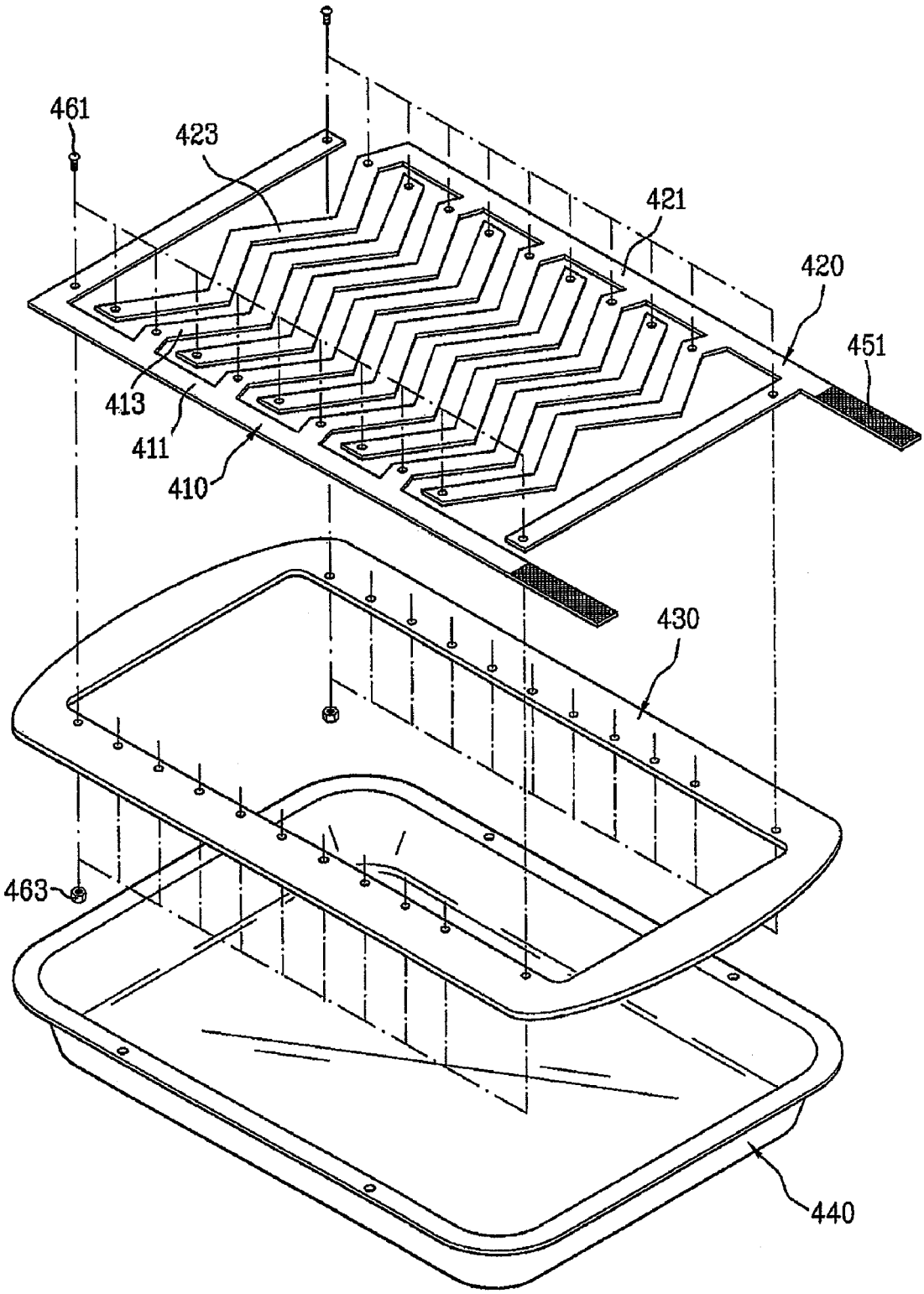
FIG. 8 is a perspective view illustrating a heating unit in the cooking appliance in FIG. 7.

A cooking appliance in accordance with another embodiment of the present invention will be described with reference to FIGS. 7 and 8, and a heating unit provided to the cooking appliance will be described in detail.

The heating unit includes cooking members 470 having a plurality of electrodes arranged not to contact with one another and to be brought into contact with food regardless of positions of the food placed thereon, and power connection portions 450 for connecting the electrodes to an external power source for supplying power to the electrodes. The cooking members 470 include a plurality of the electrodes 410 and 420 for making a current to flow to the food for cooking the food, and a cooking member frame 430 for supporting the plurality of electrodes such that the plurality of electrodes 410 and 420 are not in contact with one another. The cooking member frame serves as an electrode supporting member which supports the electrodes.

Secured to an underside of the cooking member frame 430, there is a holding container 440 for holding foreign matters including oil formed during cooking of the food. A case will be described, in which two electrodes, i.e., a first electrode 410 and a second electrode 420 are provided will be described, hereafter.

The second electrode 420 includes a plurality of electrode pins 423 arranged at fixed intervals, and an electrode body 421 which connects the electrode pins 423. Of source, the first electrode 410 also includes a plurality of electrode pins 413 and an electrode body 411 which connects the electrode pins.

The first electrode pins 413 of the first electrode 410 and the second electrode pins 423 of the second electrode 420 are arranged alternately in a state the first electrode pins 413 and the second electrode pins 423 are not in contact with each other. An external power source for supplying power to the first electrode 410 and the second electrode 420 may be either an AC or a DC power source as what is required for the external power source is to make a current to flow through the electrodes.

It is required that the food 1 being cooked is in contact both with the first electrode 410 and the second electrode 420. The current flows through the food 1 if the electrodes are made to have a voltage gap after the food 1 is made to be in contact both with the first electrode and the second electrode having a voltage gap therebetween.

Once the current flows to the food, heat is generated in the food by electric resistance of the food itself. Of course, it is required that the food 1 is a substance in a state the current can flow therethrough. For an example, the food contains a predetermined amount of moisture, or a substance in an ionized state.

In this instance, since the heat generated in the food is distributed uniformly throughout the food, the food can be cooked uniformly. Moreover, all electric energy supplied from the power source is converted into a thermal energy by resistance of food. At the end, the embodiment increases energy efficiency, and shortens a cooking time period.

The cooking member frame 430 forms a periphery of the cooking member, and has the electrode bodies 411 and 421 mounted thereon. It is preferable that the cooking member frame 430 is a nonconductor of electricity through which no current can flow. Because, if the cooking member frame 430 is a conductor, to connect the first electrode and the second electrode through the supporting member, it is liable that the current does not flow to the food which has an electric resistance greater than the supporting member, relatively.

Under the electrodes and the cooking member frame 430, there is a holding container for holding foreign matters, such as oil, discharged from the food during cooking of food. The holding container 440 has a shape in conformity with a shape of the cooking member frame 430, and fastened to the cooking member with fastening members 461 and 463.

Of course, the holding container 440 may be formed of a material which is strong to heat, and transparent so that an inside of the holding container can be viewed from an outside of the holding container. If the holding container is formed of a conductor, it is required that the first and second electrodes are not in contact therewith, and if the holding container is formed of a nonconductor, it does not matters whether the first and second electrodes are in contact therewith.

The plurality of electrodes are fixedly secured to the cooking member frame 430 with fastening members 461, and 463. The cooking member frame 430 has a rectangular ring shape, to a periphery of which the plurality of electrodes are fastened in a condition that the plurality of electrodes are not in contact with one another.

Of course, the plurality of electrodes may be used in a condition that the plurality of electrodes are simply put on the cooking member frame. Moreover, the cooking member frame may be used, not fastened to the holding container, but simply put on the holding container.

In the meantime, the heating unit has power connection portions 450 for connecting the first electrode 410 and the second electrode 420 to the external power source. The power connection portion 450 includes an electrode terminal 451 extended from the electrode, and an intermediate connection member for connecting the electrode terminal 451 to the external power source. Of course, the power connection portion may only include the electrode terminal 451 which is connected to the external power source, directly.

The intermediate connection member includes a plug 453 connected to the electrode terminal 451, and a socket 455 for connecting the plug to the external power source. The electrode terminal 451 is placed in the plug 453 directly, and the plug 453 is placed in the socket, directly. The socket 455 is a direct connection passage between the heating unit and the external power source.

Of course, there may be a socket cover (not shown) on a front of the socket for preventing foreign matters from accumulating on the socket 455. The socket cover serves to make power supply smooth by preventing contamination of the socket 455 when the heating unit is not in use. The power connection portion may include cables for connecting the electrode terminal 451 to the plug 453. The sockets may be connected to a transformer and a controller 480 which controls power to be supplied to the electrodes.

The heating unit is placed on the rack in the cavity, and the food is placed on the heating unit. However, the present invention is not limited to the foregoing embodiment, but the heating unit of the present invention can cook food separate from a cooking appliance such as the oven or a microwave oven, independently.

In detail, as far as the heating unit is connected to the external power source, the heating unit can be used anywhere. Even if the heating unit is used, not in an enclosed space, but in an open space, no thermal loss can take place easily. Because the heating unit generates a thermal energy owing to resistance of the food itself when a current is let flow through the food, and the food is cooked by the thermal energy.

A cooking appliance in accordance with another embodiment of the present invention and a heating unit provided to the cooking appliance will be described with reference to FIGS. 9 and 10.

The cooking appliance includes a body which provides a cavity 510 which is a space for cooking a cooking object, broiling heater 520 on an upper side of an inside of the cavity 510, a baking heater 530 on a lower side of the inside of the cavity 510, a heating unit detachably provided to the inside of the cavity 510, and a door (not shown) for opening/closing the cavity 510 of the body.

The heating unit includes a heater 543 for heating the food, a heater supporter 542 of substantially a rectangular hoop shape, and a holding container 544 under the heater supporter 542.

The cooking appliance also includes a power connection portion 550 for connecting the heater 543 to the external power source, and a grill 546 detachably mounted on the heater supporter 542 for placing the cooking object thereon.

Of course, the heater supporter 542 can divide the cavity into independent spaces.

The holding container 544 may be fastened to the heater supporter 542 with screws, directly. Of course, the holding container 544 may be slidably attached/detached to/from the heater supporter 542.

The power connection portion 550 of the heating unit includes cables 551 connected to the heater 543, and a plug 552 at an end of the cable for being placed in the socket 515 on one side of the cavity 510.

The socket 515 is connected to the external power source for supplying power to the heater 543 through the plug 552 and the cable 551. The socket 515 may be provided with a socket cover for preventing foreign matters such as dust and the like from accumulating on the socket 515 when the plug 552 is not placed therein.

The cavity 510 is provided with racks 561, and 562 for placing a cooking object or a container or the like having the cooking object placed therein thereon. Provided in the cavity 510, there is a rack supporting member 511 for supporting the racks 561, and 562. The rack supporting member 511 may be at least one pair of opposite grooves in opposite sides of the cavity 510. Of course, the rack supporting member 511 may be at least one pair of opposite steel wires on opposite sides of the cavity 510.

The steps of a process for cooking the cooking object with the cooking appliance of the present invention will be described with reference to FIGS. 9 and 10.

At first, after the cooking object is placed on the upper rack 561, and the heating unit is placed on the lower rack 562, a desired cooking method is selected at the control panel, and a cooking start button is pressed.

Then, power is supplied from the external power source to the broiling heater 520, the baking heater 530, or the heater 543 of the heating unit, selectively. For an example, at least one of the broiling heater 520 and the baking heater 530, and the heater 543 of the heating unit may be put into operation at the same time, or the heater 543 of the heating unit, the broiling heater 520 and the baking heater 530 may be put into operation, independently.

Figure 9:
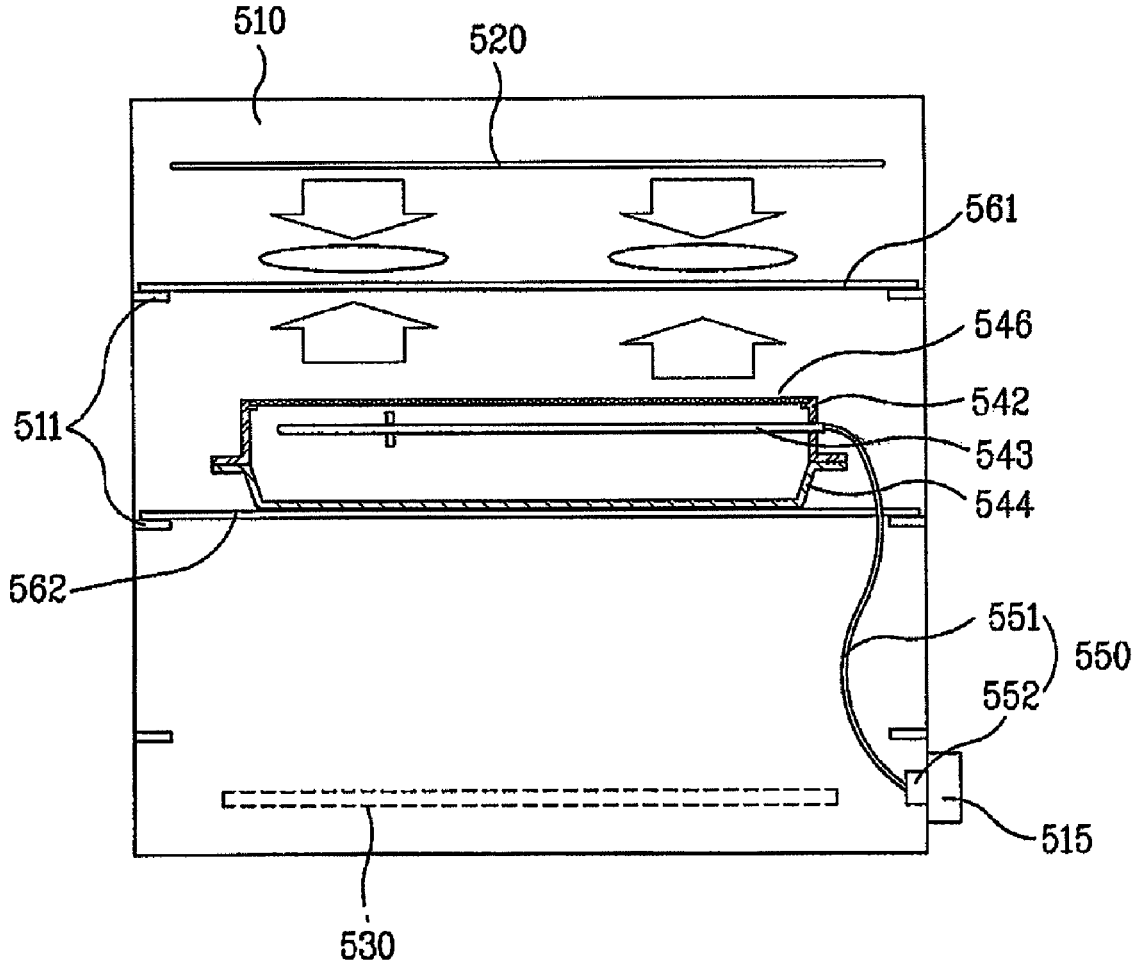
FIG. 9 is a front section illustrating a cooking appliance in accordance with another embodiment of the present invention.
Figure 10:
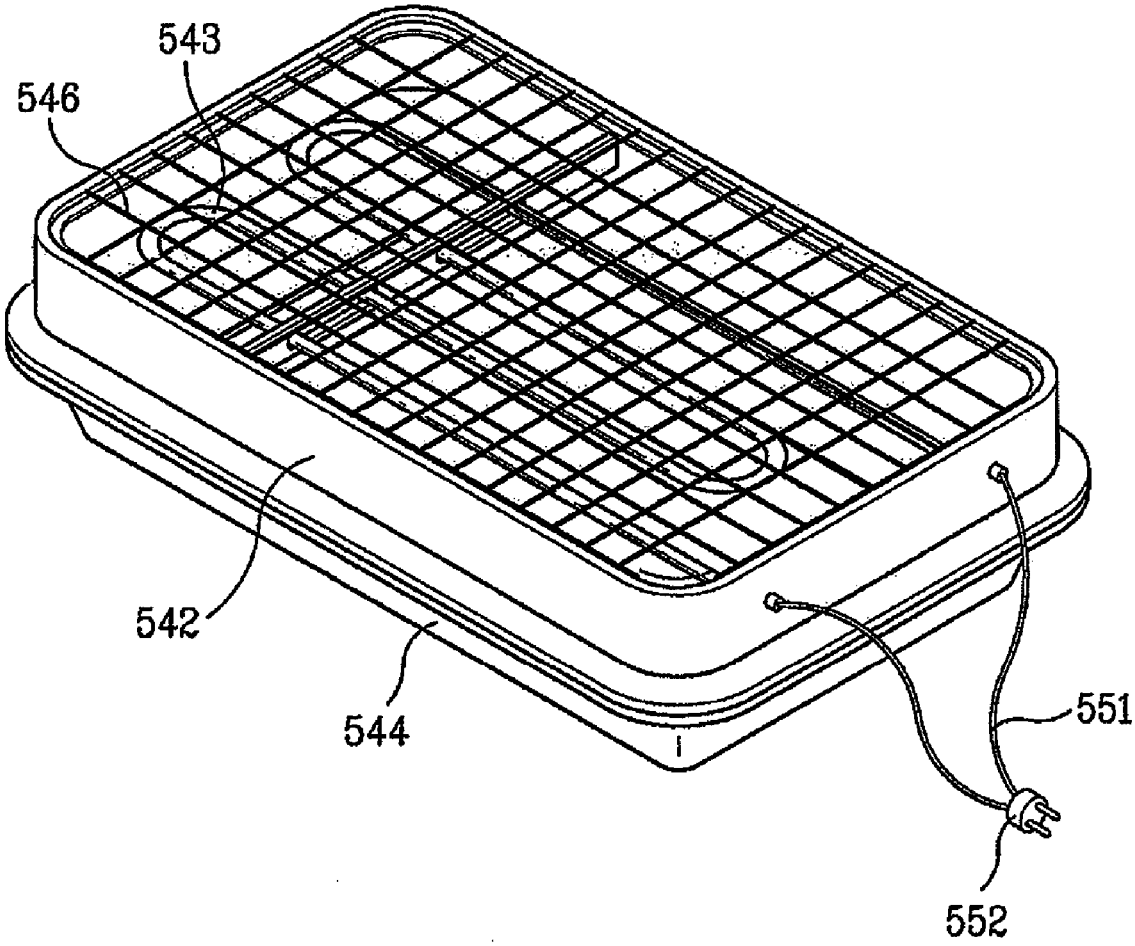
FIG. 10 is a perspective view illustrating a heating unit in the cooking appliance in FIG. 9.

Referring to FIG. 9, upon mounting the heating unit as above, placing the cooking object on the upper rack 561, and putting the cooking appliance into operation, since the broiling heater 520 and the heater 543 of the heating unit are put into operation at a time, broiling of the cooking object can be performed quickly with one time of cooking process as heat is provided both to an upper side and a lower side of the cooking object, directly.

In this instance, foreign matters, such as oil, produced from the cooking object during the cooking process is held in the holding container 544 of the heating unit.

Though not shown, more than two kinds of cooking object can be cooked with the broiling process. For an example, it may be possible that the broiling heater 520 cooks a first cooking object on the upper rack 561 over the heating unit, and the heater 543 of the heating unit cooks a second cooking object on a separate rack at the same time.

Figure 11:
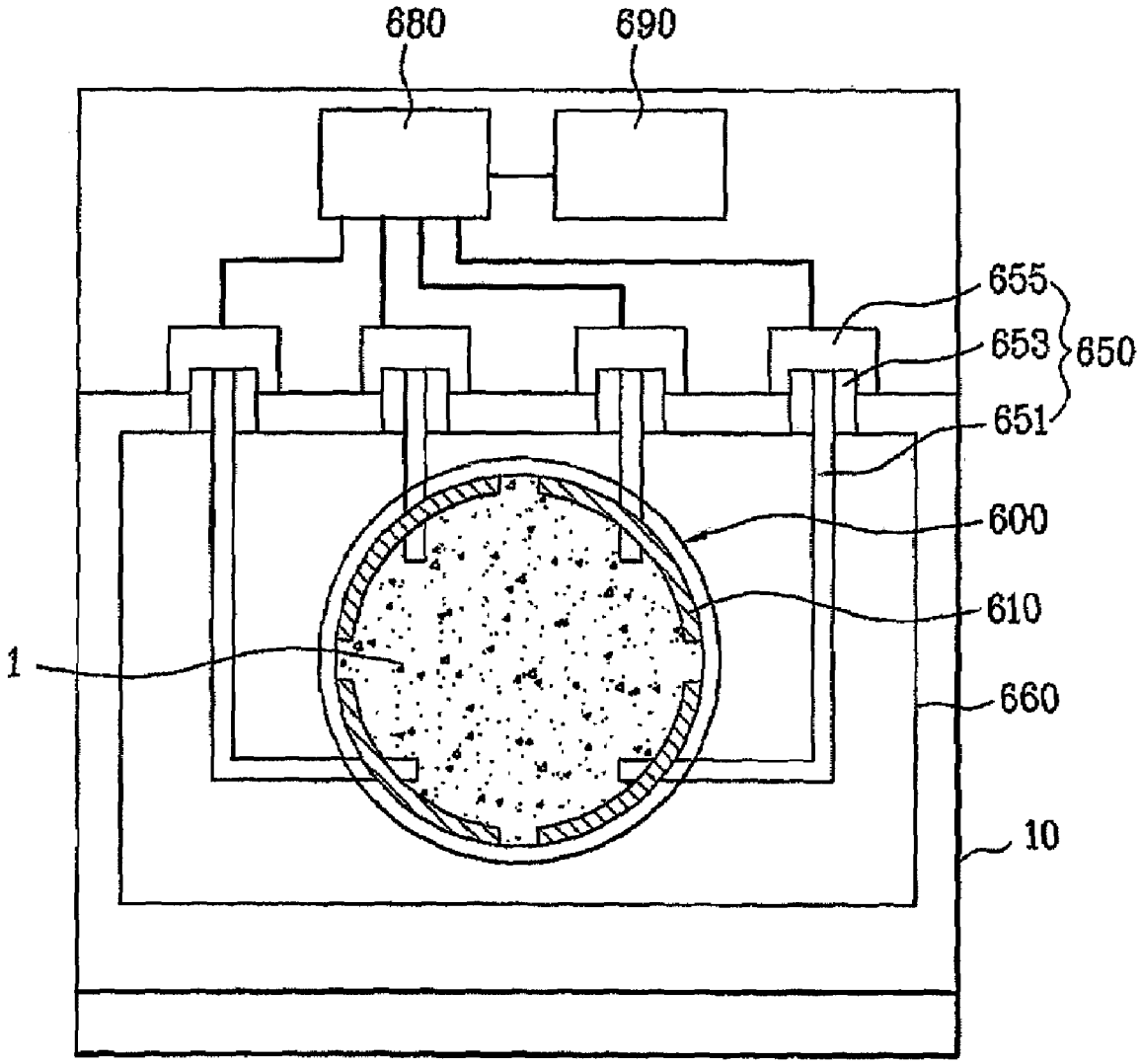
FIG. 11 is a front section illustrating a cooking appliance in accordance with another embodiment of the present invention.

A cooking appliance in accordance with another embodiment of the present invention will be described with reference to FIG. 11.

A heating unit is mounted in a cabinet 10 of the cooking appliance for cooking food by using electric resistance of the food itself. The heating unit includes a cooking container 600 for baking bread or the like, and a power connection portion 650 for connecting the cooking container to an external power source.

The cooking container 600 is provided with a plurality of electrodes 610 which are not in contact with one another and brought into contact with the food regardless of positions of food placed thereon. Detailed description of the cooking container will be given, later.

The power connection portion 650 includes an intermediate connection member 651 in contact with the electrode, and a socket 655 for connecting the intermediate connection member to the external power supply source. The power connection portion 650 may also include a plug 653 for connecting an end of the intermediate connection member to the socket 655.

One side end of the intermediate connection member 651 may be placed in the plug 653 directly, and the other end thereof may be brought into contact with the electrode 610. The number of the intermediate connection member 651 may be the same as the number of the electrodes, and the intermediate connection member 651 may be mounted on the second rack 660 where the cooking container is placed.

The intermediate connection member 651 may be mounted as one body type with the second rack 660, so that the intermediate connection member 651 forms an exterior of the second rack. Of course, the intermediate connection member may be fabricated separate from the second rack and secured to the rack.

The plug 653 on the intermediate connection member 651 is placed in the socket 655 in the cabinet, directly. The socket 655 becomes a direct connection passage between the heating unit and the external power source. The socket may have a socket cover (not shown) on a front for preventing foreign matters from accumulating on the socket 655.

The socket cover serves to make power supply smooth by preventing contamination of the socket 655 when the heating unit is not in use. Of course, the intermediate connection portion may include cables connected to the plurality of electrodes directly, and plugs for connecting the cables to the sockets, respectively.

The socket 655 is connected to a transformer 680 provided in the cabinet for supplying power according to kinds of food. The transformer 680 enables the electrodes to have proper potentials so that the electrodes can cook the food by using electric resistance of the food. The transformer 680 is connected to a controller 690 which controls power to be supplied to the electrodes, and the controller 690 is connected to the control panel on the front of the cabinet.

Accordingly, when the user selects a cooking method at the control panel, the controller 690 connected to the control panel controls the transformer, to control power being supplied to the immovable heaters and the cooking container 600.

For an example, the controller 690 serves to control the transformer to pull up/down an AC voltage of power supplied to the electrodes suitable to cook the food. The controller also controls a direction of a current to the food according to kinds of the food or the cooking methods.

In the meantime, the present invention is not limited to the foregoing embodiment, but as far as the heating unit is connected to the external power source, the heating unit can be used anywhere. Even if the heating unit is used, not in an enclosed space, but in an open space, thermal loss does not easily occur. Because the heating unit generates a thermal energy owing to resistance of the food itself when a current flows through the food, the food is cooked by the thermal energy.

In the meantime, if a voltage is applied to the plurality of electrodes 610 from the external power source, a current is made to flow to the food 1 owing to a voltage gap of the applied voltages. The current flows from the external power source to an electrode with a relatively low voltage through the food 1 via an electrode with a relatively high voltage via the intermediate connection member 651.

In this instance, since the food 1 has electric resistance of its own, an electric energy supplied thereto from an outside of the food is converted into a thermal energy, and the food is cooked by heat generated in the food. Moreover, if a thermal energy is supplied from the immovable heaters while the food is cooked with the heating unit, the food can be cooked within a relatively short time period.

Of course, by controlling a number of electrodes connected to the external power source and power applied to the plurality of electrodes, a current flow to the food can be controlled, a detailed description of which will be given, later.

Figure 12:
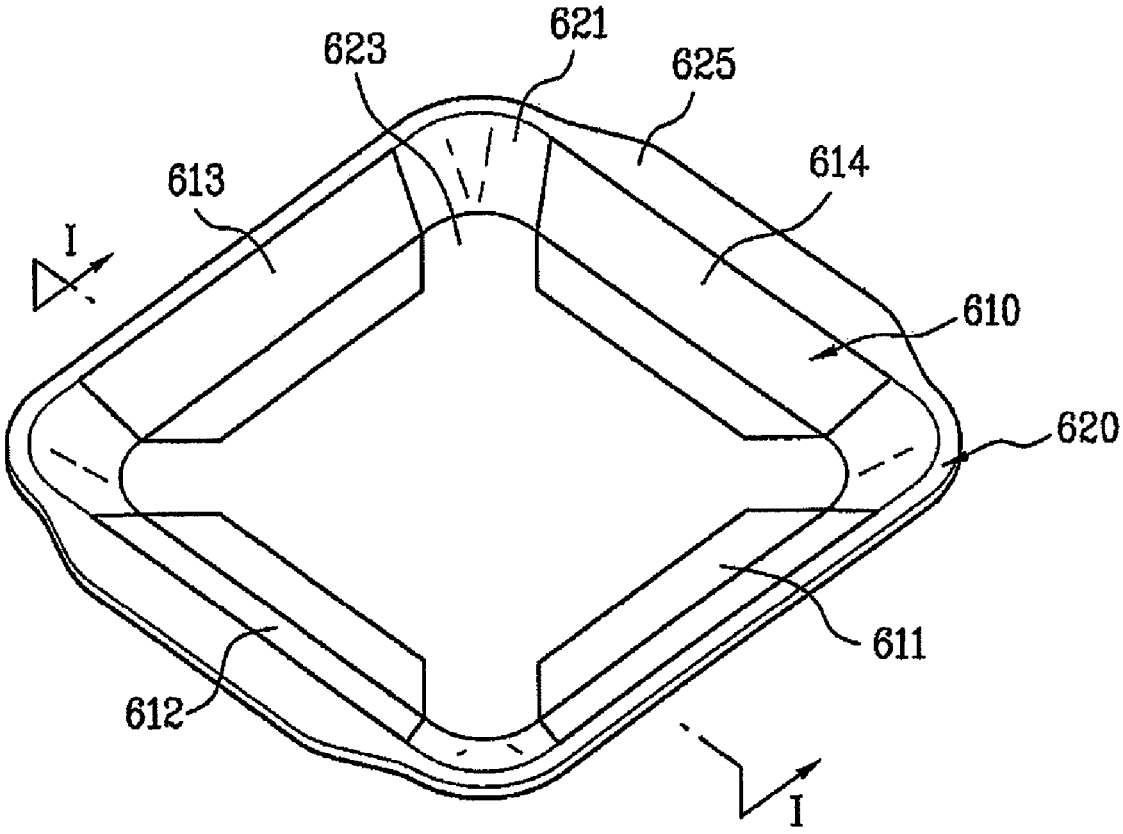
FIG. 12 is a perspective view illustrating a cooking container in FIG. 11 in accordance with a first embodiment.
Figure 13:
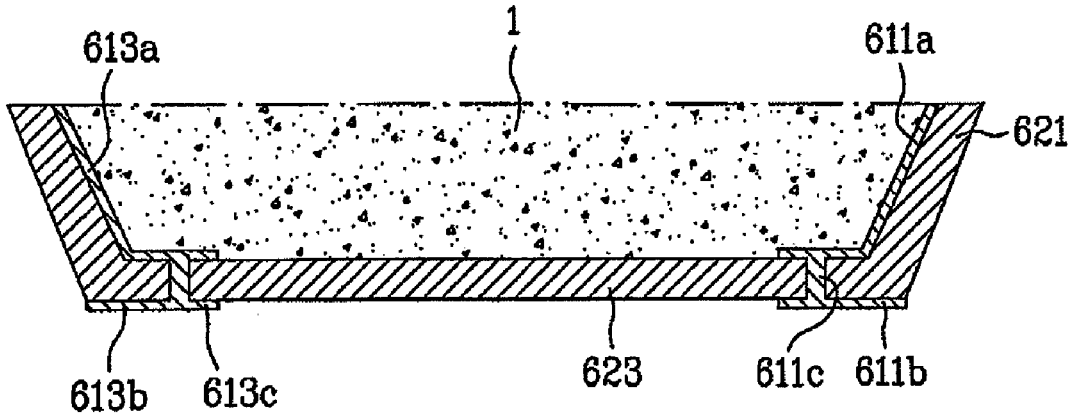
FIG. 13 is a section across a line I-I in FIG. 12.

The cooking container in accordance with an embodiment of the present invention will be described with reference to FIGS. 12 and 13.

The cooking container includes a container housing 620 for placing the food therein, and a plurality of electrodes 610 which forms an exterior of the container housing, partially. It is preferable that the container housing 620 is formed of a nonconductor through which no electricity can flow. Because, if the container housing 620 is a conductor, the plurality of electrodes can be connected through the supporting member electrically, resulting in possible failure of current flow through the food which has an electric resistance higher than the container housing 620.

Even though the container housing in accordance with a preferred embodiment of the present invention has a square pan, the present invention is not limited to above embodiment. For an example, the container housing may be a pan of a variety of shapes such as a circular shape.

The container housing 620 includes a container outer wall 621 which forms a circumference thereof, a bottom 623 extended from the container outer wall to form a bottom, and a container handle 625 for transporting the cooking container.

The container handle 625 is projected from a top of the outer wall to left/right sides, and may be formed of a material of a low thermal conductivity. The plurality of electrodes 610 are arranged not to be in contact with one another, and connected to the external power source, respectively.

In the embodiment, the plurality of electrodes are a first electrode 611, a second electrode 612, a third electrode 613, and a fourth electrode 614 formed on the outer wall of the square container. The embodiment will be described based on the first electrode 611 and the third electrode 613 illustrated in FIG. 13.

Each of the electrodes includes an inner portion 611*a*, or 613*a* on an inside of the container housing, an outer portion 611*b*, or 613*b* on an outside of the container housing, a connection portion 611*c*, or 613*c* passed through the bottom 623 of the container housing to connect the inner portion to the outer portion. In this instance, as the inner portion 611*a*, or 613*a* is to be in contact with the food directly, and the outer portion 611*b*, or 613*b* is connected to the external power source, the cooking of food is made possible.

After the food 1 to be cooked is brought into contact with the first electrode 611 and the third electrode 613, if a voltage gap takes place between the electrodes, a current is made to flow to the food 1. Once the current flows to the food, heat is generated in the food by electric resistance of the food itself. Of course, it is required that the food 1 is a substance of a state a current can flow thereto. For an example, the food 1 is required to have a predetermined moisture content, or to contain an ionized state substance.

Since the heat generated in the food spreads throughout the food uniformly, the food can be cooked uniformly. Moreover, an electric energy from the power source is converted into a thermal energy by the resistance of the food, entirely. Eventually, the embodiment has advantages in that energy efficiency is improved, and a cooking time period is shortened.

Figure 14:
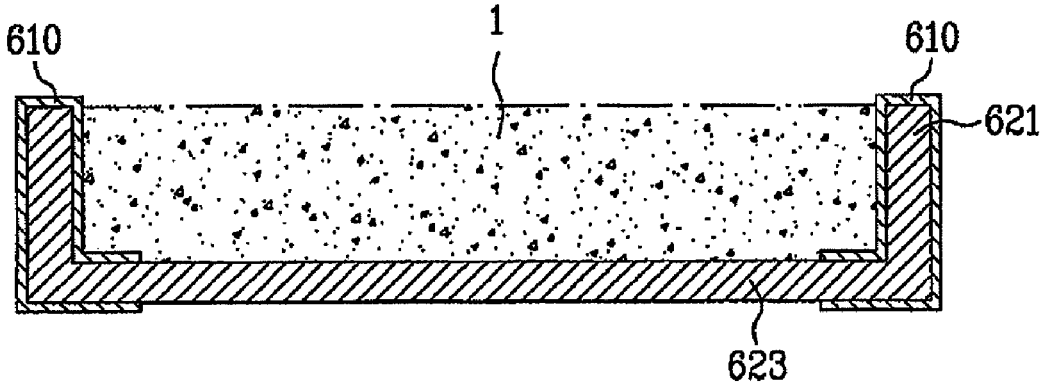
FIG. 14 is a sectional view illustrating a cooking container in FIG. 11 in accordance with a second embodiment.

The cooking container in accordance with another embodiment of the present invention will be described with reference to FIG. 14. Similar to the foregoing embodiment, the cooking container of this embodiment includes a container housing for placing the food therein, and a plurality of electrodes 610 which form an exterior of the container housing, partially.

The container housing includes a container outer wall 621 which forms a circumference thereof, and a bottom 623 extended from the container outer wall 621 to form a bottom. However, different from the foregoing embodiment, the cooking container of the embodiment has a shape of a circular pan, and the electrodes 610 thereof surrounds a portion of the container outer wall 621 and extended to a portion of the bottom.

The electrode has one side provided to an inside of the container outer wall, and the other side provided to an outside of the container housing. The electrode on the inside of the container outer wall is to be brought into contact with the food 1 directly, and the electrode on the outside of the container outer wall is connected to the external power source.

Of course, the electrode 610 may be provided, not to the bottom, but only to the container outer wall 621, or provided as one body with the container outer wall 621.

A method for controlling a current flow to the cooking container will be described with reference to FIGS. 15A~15D.

In order to bake food, such as bread or cake, the cooking container having the food placed therein is placed in the cabinet. In this instance, the cooking container is brought into contact with the power connection portion so that the cooking container can be connected to the external power source.

The user brings the plurality of electrodes which partially form the exterior of the cooking container into contact with the intermediate connection members, respectively. Of course, the cooking container may be placed according to a positioning guide which sets a position of the cooking container.

Next, the user presses an operation button for cooking the food. In this instance, the user can select a food cooking method having a kind of the food and the like taken into account. Then, the controller of the cooking appliance controls a current flow direction to the food according to the cooking method. In detail, the controller of the cooking appliance controls the current flow direction by supplying power to two or more electrodes, selectively.

Figure 15A:
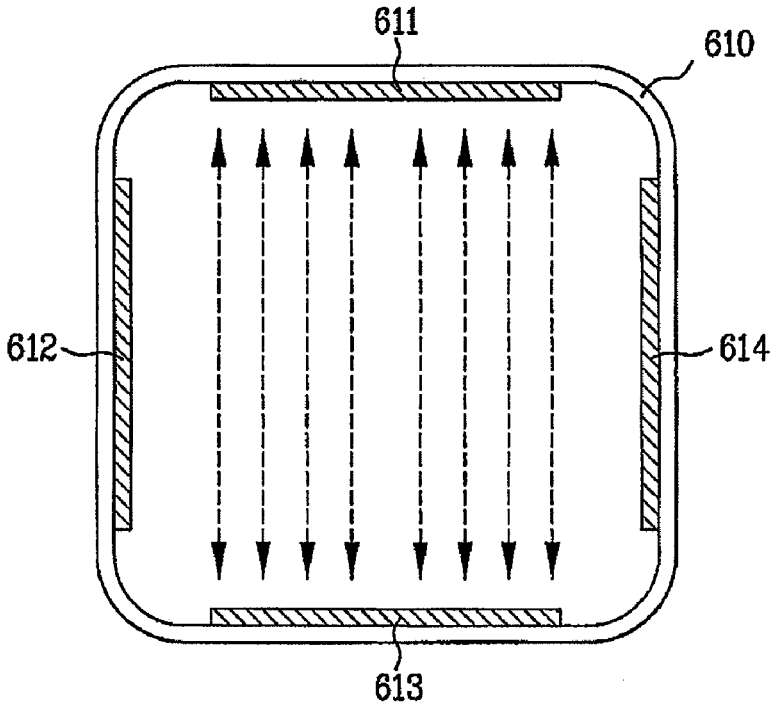
FIG. 15A is a diagram illustrating a direction of a current flowing in the cooking container in FIG. 14 in accordance with a first embodiment.

Referring to FIG. 15A, if the controller supplies power to the first electrode 611 and the third electrode 613 positioned opposite to each other, the current flows between the first electrode and the third electrode, only. That is, no current flows between the second electrode 612 and the fourth electrode 114.

Figure 15B:
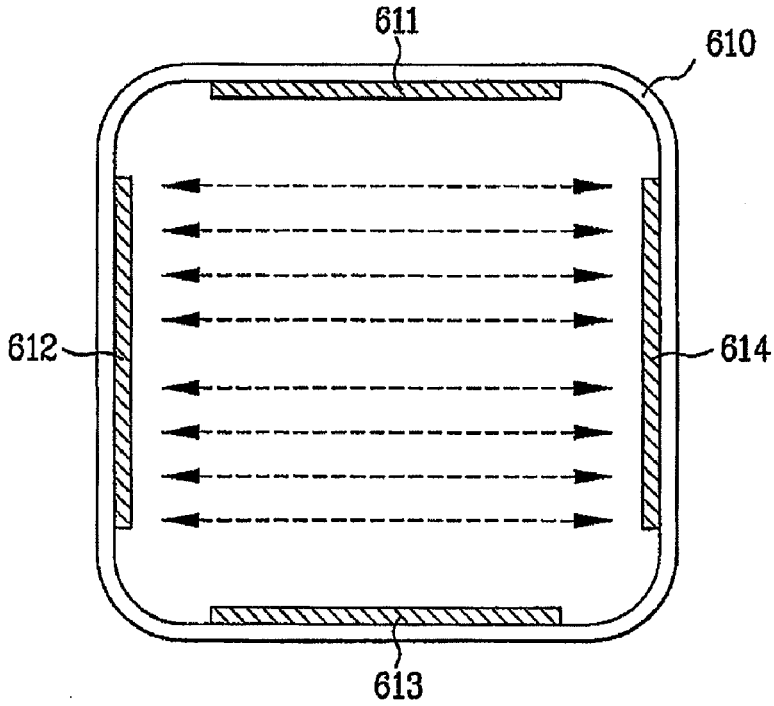
FIG. 15B is a diagram illustrating a direction of a current flowing in the cooking container in FIG. 14 in accordance with a second embodiment.

Similarly, referring to FIG. 15B, if the power is supplied only to the second electrode 112 and the fourth electrode 114, the current flows between the second electrode and the fourth electrode, only.

Figure 15C:
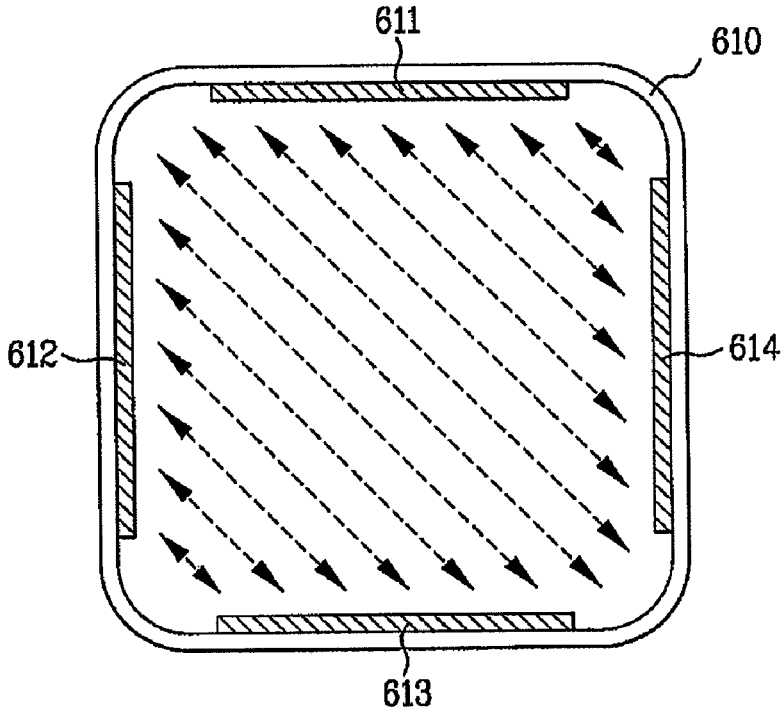
FIG. 15C is a diagram illustrating a direction of a current flowing in the cooking container in FIG. 14 in accordance with a third embodiment.

Moreover, referring to FIG. 15C, the controller can control the current to flow between adjacent electrodes. In detail, if the first electrode 611 and the second electrode 612 have the same low voltage V1, and the third electrode 613 and the fourth electrode 614 have the same high voltage V2, the current flows from the third electrode 613 to the second electrode 612, and from the fourth electrode 614 to the first electrode 611.

Figure 15D:
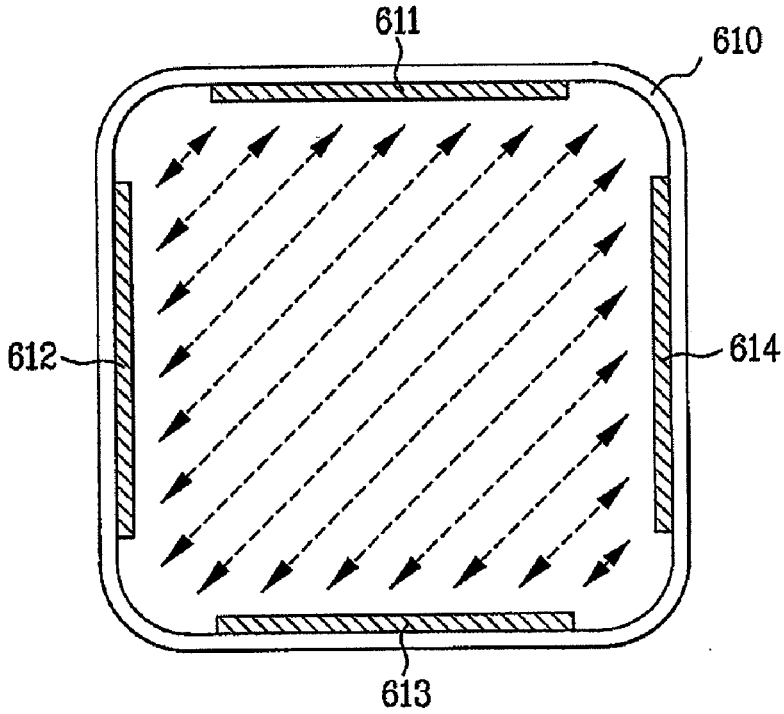
FIG. 15D is a diagram illustrating a direction of a current flowing in the cooking container in FIG. 14 in accordance with a fourth embodiment.

Moreover, referring to FIG. 15D, if the first electrode 611 and the fourth electrode 614 have the same low voltage V3, and the second electrode 612 and the third electrode 613 have the same high voltage V4, the current flows from the second electrode 612 to the first electrode 611, and from the third electrode 613 to the fourth electrode 614.

Accordingly, the controller can make the current to flow between electrodes opposite to each other, or adjacent to each other. At the end, the controller can change the current flow freely according to a preset method, or user's selection.

Of course, the plurality of electrodes may be four or more than four, and the power source may be either AC or DC.

Figure 16:
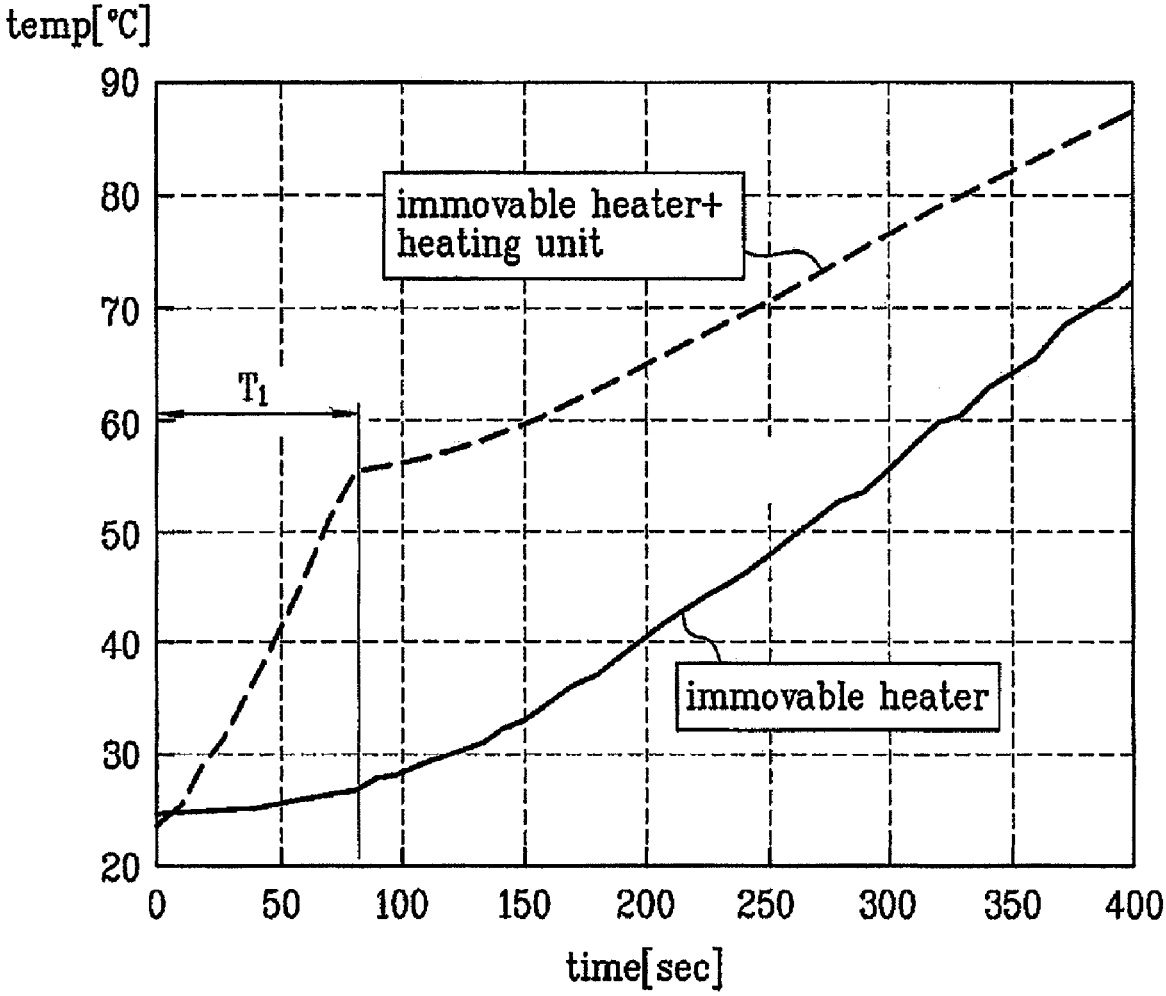
FIG. 16 is a graph illustrating performances of cooking appliances in accordance with the present invention.

Referring to FIG. 16, a performance of the cooking appliance of the present invention will be described. In cooking food, an amount of thermal energy transmitted to the food at an initial stage fixes a cooking rate of the food. Because, if the food reaches to a certain temperature, it is adequate that a temperature of the food thereafter rises or maintained to/at a level at which the food does not burn.

FIG. 16 illustrates a graph showing a temperature change of the food versus time, wherein a dashed line represents a graph showing a temperature change of food when both the heating unit and the immovable heaters of the present invention are used, and a solid line represents a graph showing a temperature change of food when only the immovable heaters of the present invention are used. The temperature of the food is an average of temperatures measured at 9 points distributed throughout the food. 5000 W is used for the immovable heater, and 350 W is used for the heating unit of the present invention.

Upon reviewing the graph, it can be known that the temperature of the food heated by the heating unit of the present invention changes sharply until Tl after starting of cooking of the food. In heating the food, it can be known that the temperature rises at 4 to 5 times faster in a case both the heating unit and the immovable heaters are used than a case when only the immovable heaters are used.

A cooking appliance and a method for controlling the same of present invention have the following advantages.

First, the cooking appliance of the present invention can be used conveniently without being limited by an installed position because the user can use the heating unit independently, and can move it easily.

Second, since a plurality of electrodes which are not in contact with one another are used in application of a current to the food in heating the food, a time period required for heating down to an inside of the food can be shortened. Moreover, since the current flows throughout the food, the food is cooked uniformly throughout the food.

Third, since the heating of food with an electric resistance of the food itself by making a current to flow through the food reduces a thermal energy leaked to an outside of the food, energy efficiency increases.

Fourth, the simple assembly process of the plurality of the electrodes and the supporting member the electrodes are to be placed thereon by using, not separate fastening members, but the fastening projections and the fastening holes at the electrodes and the supporting member permits fast assembly, and low assembly cost.

Fifth, the possibility of cooking food according to user's taste on a cooked state of the food or kinds of food selectively permits to provide food cooked according to a desired of the user.

Sixth, by securing a contact area between the food and the electrode by bending the plurality of electrode pins permits efficient cooking of the food.

Seventh, the current flow direction control in the present invention permits effective heating of heating of the food throughout the food.

It will be apparent to those skilled in the art that various modifications and variations can be made in the present invention. Thus, it is intended that the present invention covers such modifications and variations of the invention.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

Although the invention has been described with reference to exemplary embodiments, it is understood that the words that have been used are words of description and illustration, rather than words of limitation. As the present invention may be embodied in several forms without departing from the spirit or essential characteristics thereof, it should also be understood that the above-described embodiment is not limited by any of the details of the foregoing description, unless otherwise specified. Rather, the above-described embodiment should be construed broadly within the spirit and scope of the present invention as defined in the appended claims. Therefore, changes may be made within the metes and bounds of the appended claims, as presently stated and as amended, without departing from the scope and spirit of the invention in its aspects.

What is claimed is:

1. A cooking apparatus comprising:

a housing including a cooking chamber;

a heating unit detachably mounted in the housing; and a power connection portion comprising a cable and plug configured to connect the heating unit to an external power source, wherein the heating unit can heat food when the heating unit is located in the housing, and the heating unit can independently heat food when the heating unit is removed from the housing.

2. The cooking apparatus of claim 1, wherein the heating unit includes a plurality of electrodes which are not in contact with one another and are configured to be brought into contact with the food.

3. The cooking apparatus of claim 2, wherein the heating unit further includes electrode supporting members that support the plurality of electrodes.

4. The cooking apparatus of claim 1, wherein the heating unit further includes a container configured to hold foreign matter formed during cooking of food.

5. The cooking apparatus of claim 2, wherein each electrode includes electrode pins arranged at predetermined intervals and an electrode body connecting the electrode pins.

6. The cooking apparatus of claim 4, wherein the heating unit further includes a guide that guides foreign matter from the food to the container.

7. The cooking apparatus of claim 3, wherein the heating unit further includes:

fastening projections provided on the electrodes or the electrode supporting members, and fastening holes provided in the other of the electrodes or the electrode supporting members, and corresponding to the fastening projections.

8. The cooking apparatus of claim 2, further comprising a transformer for varying power to the electrodes according to the type of food to be heated.

9. The cooking apparatus of claim 2, wherein the power connection portion includes:

a socket connected to the plurality of electrodes, and a socket cover for preventing foreign matter from accumulating on the socket.

10. The cooking apparatus of claim 2, wherein the power connection portion includes:

an electrode terminal extended from each of the electrodes, and an intermediate connection member for connecting the electrode terminal to the external power source.

11. The cooking apparatus of claim 1, wherein the heating unit includes;

a heater configured to heat the food, and a heater support that supports the heater.

12. The cooking apparatus of claim 11, wherein the heating unit further includes a grill provided on the heater support for supporting the food thereon.

13. The cooking apparatus of claim 11, wherein the heating unit further includes a container located under the heater support for holding foreign matter formed during cooking of the food.

14. The cooking apparatus of claim 1, further comprising a rack for supporting the heating unit in the cooking chamber, and a rack supporting member that supports the rack.

15. The cooking apparatus of claim 2, wherein at least some of the plurality of electrodes form an exterior of a cooking container in which the food is placed.

16. The cooking apparatus of claim 15, wherein the electrodes have one side forming a portion of an inside of the cooking container, and another side forming a portion of an outside of the cooking container.

17. The cooking apparatus of claim 16, wherein the electrodes are passed through a container wall from the inside to the outside of the container.

18. The cooking apparatus of claim 15, further comprising a controller that controls a direction of current flow through the food in the cooking container.

* * * * *